United States Patent [19]

Dombrowski et al.

[11] 4,258,238

[45] Mar. 24, 1981

[54] LIQUID LEVEL SIGNAL TRANSMITTER

[75] Inventors: Ferdinand Dombrowski, Kaarst-Vorst; Dieter Förster, Haan, both of Fed. Rep. of Germany

[73] Assignee: Sunvic Regler GmbH, Solingen, Fed. Rep. of Germany

[21] Appl. No.: 65,177

[22] Filed: Aug. 9, 1979

[30] Foreign Application Priority Data

Sep. 6, 1978 [GB] United Kingdom ..... 2838723

[51] Int. Cl.[3] ..... H01H 35/18

[52] U.S. Cl. ..... 200/84 C; 73/313; 340/625

[58] Field of Search ..... 335/202, 205, 151; 200/302, 61.2, 84 R, 84 C; 340/623, 625; 73/308, 313, 317

[56] References Cited

U.S. PATENT DOCUMENTS

| | | | |
|---|---|---|---|
| 3,250,875 | 5/1966 | Wintress | 335/151 |
| 3,751,616 | 8/1973 | Innes | 200/84 C |

FOREIGN PATENT DOCUMENTS

| | | |
|---|---|---|
| 1149077 | 12/1963 | Fed. Rep. of Germany . |
| 2627253 | 12/1977 | Fed. Rep. of Germany . |
| 521573 | 5/1972 | Switzerland . |
| 1391776 | 4/1975 | United Kingdom . |

*Primary Examiner*—Gerald P. Tolin

*Attorney, Agent, or Firm*—Arthur E. Hoffman

[57] ABSTRACT

The housing of a reed switch, actuatable by magnetic flux, is supported at the ends by grommets fitting snugly inside an aluminum sleeve. The switch terminals extend from the housing adjacent a closed end of the sleeve, have lead wires soldered to them and are in an embedment of silicone rubber. A cable having electric lines projects into an open end of the sleeve. After passing through an insulating spacer plate the wires are soldered to the cable lines. The portion of the sleeve between the open end and the adjacent grommet is filled with a silicone rubber embedment. The sleeve is positioned in a bore in a mounting body and adjacent a side of the body is a float responsive magnet.

12 Claims, 5 Drawing Figures

LIQUID LEVEL SIGNAL TRANSMITTER

BACKGROUND AND SUMMARY OF THE INVENTION

The invention relates to a liquid level signal transmitter including magnetic drive means, in which transmitter a switch designed as a reed switch in an inert gas-filled housing is actuated by a magnet connected to a float, and in which transmitter said housing of said reed switch is received in a sleeve closed at one end and is encased in a poured sealing mass.

Such a liquid level signal transmitter is inteded to indicate whether a predetermined level of liquid in a container is reached or not. The switch will correspondingly assume one or the other of two switching positions. A movable float within the interior of the container is lifted by the liquid. When the float arrives at the predetermined liquid level, a switch located outside the liquid container is actuated. Magnetic drive means are known for avoiding the sealing problems associated with mechanical members passing through the container wall. In such magnetic drive means a magnet is connected to the float. That magnet through a flange of non-magnetic material acts on an armature moving with the float movement and actuating switch. Usually, the armature and the switch are mounted in a housing located at the outside of the flange. Considerable problems have resulted therefrom in practice.

Wide temperature fluctuations may occur in the container, the liquid level in which is to be monitored, during the course of chemical processes. Temperatures may change between minimum values well below the freezing point and relatively high temperatures, say for instance between −196 and +180 degrees centigrade. This will result in wide temperature variations of the housing and of the switching mechanism disposed therein. Such variations in the housing temperature may also occur through exterior effects like changes in the exterior temperture.

The air pressure in the housing will decrease when the housing cools. Thus through leaks in the housing, air will be sucked in from the atmosphere. That air contains humidity, a portion of which will condense on the interior wall of the housing and on the surfaces of the parts placed in the housing and freeze on parts whose temperature is below freezing. On rewarming the housing and the air contained therein, above ambient pressure will develop in the housing and result in an exhaust of air from the housing. At least a portion of the moisture condensed from the air, however, will remain within the interior of the housing during this process. This effect, which subsequently will be described as a "breathing" or "pumping effect" is cumulative and after a significant period of operation of the instrument a layer of ice will form sufficient to block the operation of the switch or cause short-circuits.

There have been different attempts at preventing such undesired phenomenon.

Initially it was tried to prevent the entry of outside air into the housing by sealing. Generally, the sealing has not been sufficiently secure to prevent the accumulation of moisture within the housing but only to delay it. It has been shown, for instance, that outside air enters the housing along the cable insulation. A seal of the housing to preclude the entry of air therein due to temperature variations occurring for long periods of operation, if ever feasible at all, will exceed the tenable cost for technical instruments.

Also, absorption of the moisture entering the housing by a desiccant like silica gel disposed in the housing has been attempted. This, however, will delay accumulation of moisture and ice formation within the interior of the housing only for the period of time required for saturating the silica gel with moisture.

Another alternative attempted has been to heat the housing to prevent condensation of humidity within the housing. Such heating requires a continuous energy consumption. Also, the heating may not be permitted in instruments for use in rooms which may contain an explosive atmoshpere.

A liquid level signal transmitter comprising a disc shaped flange or body and a double-armed lever extending normal to the flange and supporting a float with one arm and a magnet with the other arm, said magnet actuating a switch right through the flange, is known for instance through German Patent Specification No. 1,149,077. However, in this known arrangement the switch is situated within a relatively large housing so that even after sealing of that housing the initially described breathing effect will occur.

A liquid level signal transmitter is known in which the electrical switch is a reed switch in an inert gas-filled housing, said switch being located within a cavity formed by a radial bore in the flange (Swiss Patent Specification No. 521,573). In this known arrangement the flange forms a horizontal cover of a housing communicating with the container. A float is guided for vertical movement within the housing. In this known arrangement the float naturally is unbalanced. The float must be buoyant within the liquid to move upwardly towards the cover as the liquid level rises and to bring a magnet affixed to the float within the range of the reed switch. Such a liquid level signal transmitter is unsuited for monitoring the liquid level of low density liquids under high pressures, for example liquefied gases. The cavity within the flange holds a relatively great volume of air in which the connecting terminals of the reed switch are located. For the reasons mentioned and in spite of the cavity being sealed from the outside, moisture can accumulate within the cavity because of the breathing effect upon periodical, large temperature variations, which moisture in the course of time will impair the ability of the signal transmitter to function.

Furthermore, an arrangement including a reed switch located in a vertically disposed, elongate sleeve is known (British Patent Specification No. 1,391,776) said sleeve projecting centrally into a housing connected to the container and being closed at its lower end. A float including a permanent magnet is movably guided along the cylindrical face of the sleeve. The interior of the sleeve is filled by an insulating mass. In this known arrangement the insulating mass serves the purpose to ensure insulating of the central supply line to the reed switch from the metallic sleeve which serves as the return line. Actuation of the reed switch in this known arrangement occurs by vertical movement of the unbalanced float along the sleeve. Thus the float must be buoyant in the liquid to be monitored. This also will preclude an employment of such arrangement in a liquid of low density at high pressure like a liquefied gas.

Through German Offenlegungsschrift No. 26 27 253 a liquid level signal transmitter including magnetic drive means is known in which a float is supported by means of a double-armed lever at the interior face of a flange being designed for vertical mounting at the container and covering an opening in the container wall. A magnet is located at the flange supporting end of the lever. This magnet actuates a reed switch. The reed switch is located within a sleeve closed at its interior end and disposed within a radial bore of the flange. The interior space of the sleeve is filled with a poured sealing mass around the inert gas-filled reed switch housing. There is practically no volume of air in such an arrangement which might cause a breathing effect.

With an unfavorable selection of materials tensions may occur at the reed switch housing due to different thermal expansions in the materials as used. Thereby the switching point of the reed switch may be displaced. Also, faulty switching may occur which may have severe consequences in chemical processes. From the requirement for accommodating the materials in their thermal expansion over wide temperture ranges an undesired restriction on the material selection results.

An object of the present invention is to provide a liquid level signal transmitter of the kind as defined initially and including magnetic drive means, which transmitter will work trouble-free for long periods of operation even with continous periodical temperature variations and which additionally avoids faulty function of the reed switch due to different thermal expansions of the materials employed.

According to the invention, this object is achieved by sealingly retaining the outer end of the reed switch housing facing the open end of the sleeve at a rubber-elastic plate engaging the interior wall of said sleeve, by soldering the connecting wires of the reed switch to the lines of a connecting cable within a space formed in said sleeve intermediate said rubber-elastic plate and said open end of said sleeve and by filling said space with a pourable sealing mass having a low coefficient of thermal expansion, the soldered spots being tightly encased into said pourable sealing mass.

DESCRIPTION OF SPECIFIC EMBODIMENT

Figure 1:
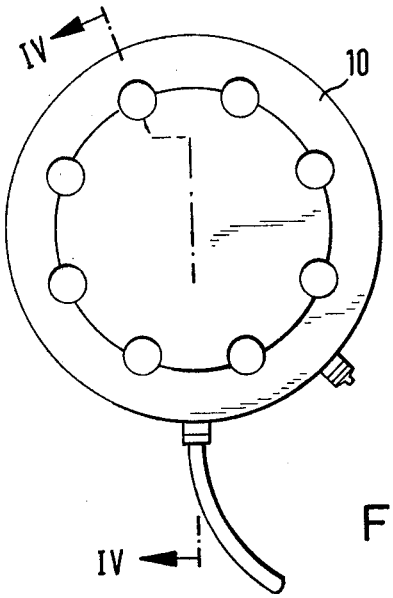
FIG. 1 is a front view of a flange or body of a liquid level signal transmitter embodying the invention.
Figure 2:
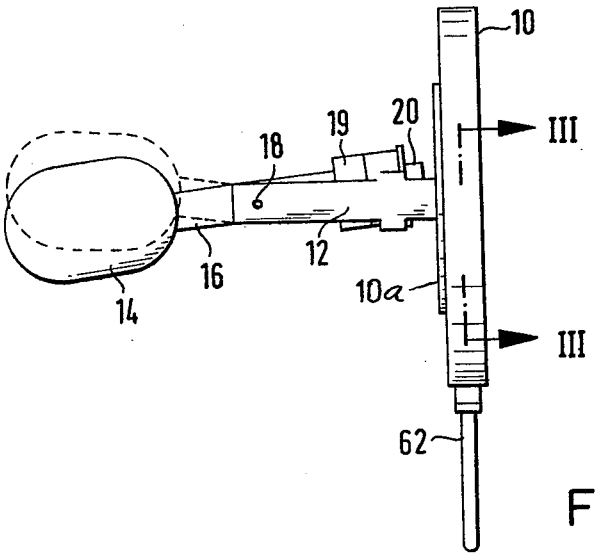
FIG. 2 is a side view.

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

In the illustrated embodiment there is a flange or body 10 which is to be mounted over and covering a gap in the wall of a container (not shown) in the usual manner. A pair of spaced horizontal support arms 12 extend from the interior face 10*a* of the flange 10 into the container. A float 14 has a double-armed lever positioned between the support arms and connected thereto for pivotable movement about a generally horizontal axis 16. A counterweight 19 and a magnet enclosed in a suitable capsule 20 are located at the distal end of lever 18 facing the flange. The weight of float 14 substantially is balanced by counterweight 19. Encapusulated magnet 20 closely adjacent to the interior face of the flange when float 14 is lifted under the influence of buoyancy. That interior face is made of non-magnetic material.

Figure 4:
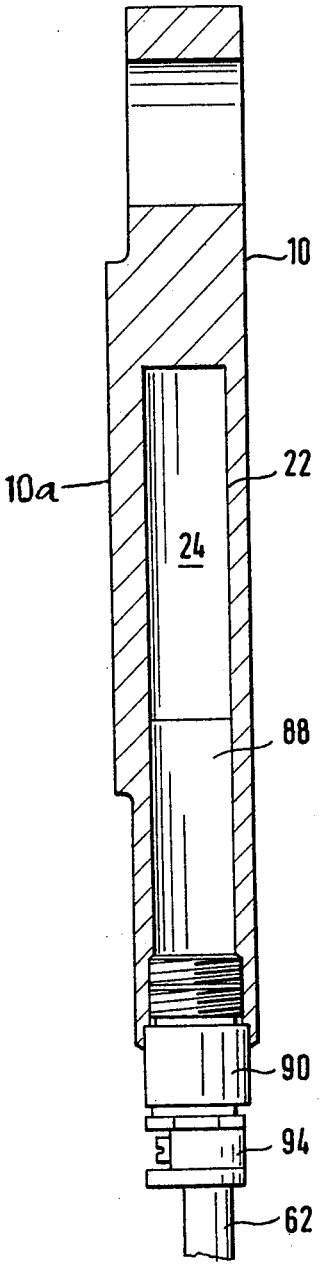
FIG. 4 is a section as seen at line IV—IV of FIG. 1.
Figure 3:
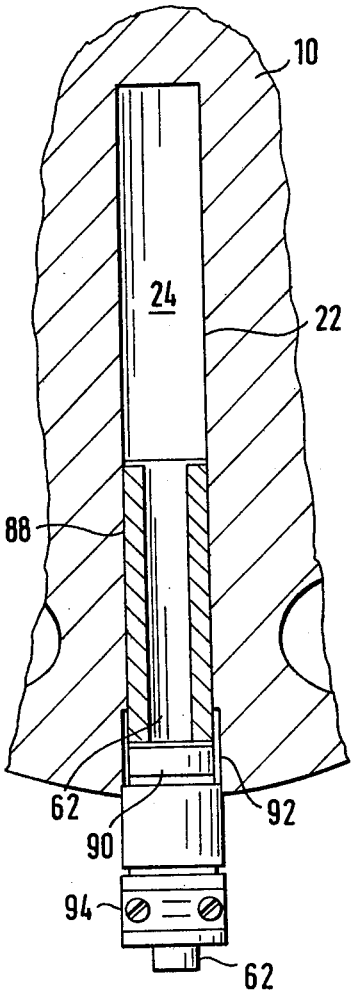
FIG. 3 is a partial section as seen at line III—III of FIG. 2.

As seen in FIGS. 3 and 4, flange 10 has a radial bore 22 extending acroos the center of the flange. A sleeve 24, generally made of an aluminum alloy is mounted in this bore. The outer diameter of sleeve 24 essentially corresponds to the diameter of bore 22. Sleeve 24 has a closed end 40, an open end 52 and defines a space or cavity 64 therebetween.

Figure 5:
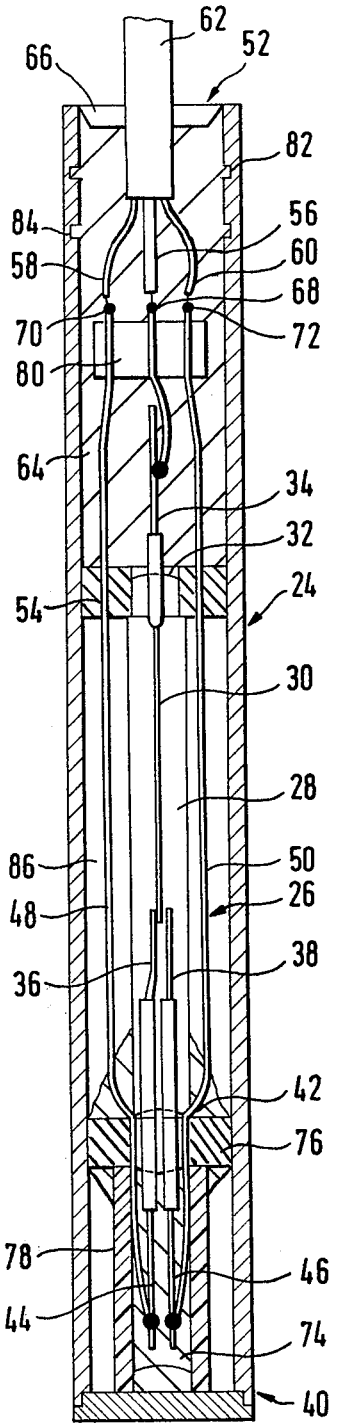
FIG. 5 is an enlarged longitudinal section of a sleeve for a reed switch, which sleeve is inserted into a radial bore in the flange or body.

FIG. 5 is a longitudinal section through the sleeve 24 on an enlarged scale, with the sleeve inverted from the position at which it is shown in FIG. 3. A reed switch 26 mounted in an elongate inert gas-filled housing 28 is positioned in the sleeve. The reed switch includes a tongue 30 of ferromagnetic material positioned centrally of, and extending in longitudinal direction of, the inert gas-filled housing 28. Tongue 30 has a proximal end which passes through, and is retained by, the end 32 of housing 28. It terminates outside the housing in a connecting wire 34. The distal end of the tongue is located intermediate two fixed contacts 36, 38, one of which is also of ferromagnetic material. Both of said contacts 36 and 38 are sealed into, and pass through, end 42 of housing 28, with the housing thus supporting the contacts. Externally of housing 28 the contacts 36, 38 end in terminals 44 and 46, respectively, to which connecting wires 48 and 50, respectively, are soldered. Wires 48 and 50 are poly tetrafluoroethylene enclosed stranded wires.

The end 32 of housing 28 faces the open end 52 of sleeve 24 and is sealingly retained by an elastomeric plate or grommet 54, preferably made from silicone rubber. Plate 54 also engages the interior wall of the sleeve. The connecting wires 34, 48, and 50 of reed switch 26 are soldered to lines 56, 58, and 60, respectively, of a connecting cable 62. Those soldered joints 68, 70, 72 are within a space 64 within sleeve 24 intermediate plate 54 and the open end 52 of the sleeve, which space then is filled with an embedment of a pourable sealing mass 66 having a low coefficient of thermal expansion, the sealing mass tightly encasing the soldered joints.

Silicone rubber 74 is poured about the inner end 42 of the housing 28 of reed switch 26 facing the closed end 40 of sleeve 24 and about the terminals 44, 46 provided at this end to form an embedment. The inner end 42 of housing 28 about which silicon rubber 74 is poured is sealingly retained in a second elastomeric plate or grommet 76 also engaging the interior wall of sleeve 24. A sleeve 78 of plastic, perferably poly tetrafluoroethylene, extends intermediate the second rubber-elastic plate 76 and the closed end 40 of sleeve 24 and encloses the inner end 42 of the housing about which end silicone rubber 74 has been poured.

The connecting wires 34, 48, and 50 of reed switch 26 are spaced from each other by a rubber-elastic plate 80 having a reduced diameter as compared to the inner diameter of sleeve 24, said plate being held within and encased by the filling 66 in the sleeve 24 intermediate the soldering spots 68, 70, 72 and the housing 28. The interior wall of sleeve 24 has two annular grooves 82, 84 in the location of the filled up space 64, specifically above soldering spots 68, 70, 72. This enables the embedment 66 to lock to the sleeve and resist longitudinal displacement.

The connecting cable 62 includes an air tight covering of poly tetrafluoroethylene. This cover extends into the sealing mass 66 which fills space 64.

An annular air space 86 exists within sleeve 24 between the rubber-elastic plates 54 and 76 and about the housing 28. To avoid the initially described pumping effect the volume of air in that air space 86 should be smaller than 5 milliliter, preferably 4 milliliter.

Sleeve 24 is introduced into the radial bore 22 in flange 10 in the manner as shown in FIGS. 3 and 4. The sleeve must be positioned in an orientation known to the art, such that the magnetic flux from encapsulated 20 will cause a switch actuation as desired. A pressure bushing 88 surrounds the connecting cable 62 and abuts the end face of sleeve 24 at the open end 52 thereof. The pressure bushing 88 is secured by means of a threaded ring 90 engaging screw threads 92 at the outer end of the bore 22. Threaded ring 90 has a conventional pull relief clamp 94 engaging cable 62.

It has proven advantageous to have the open end of radial bore 22 of the flange positioned to face downwardly in the assembled position, the sleeve 24 located therein being accordingly arranged with the connecting cable 62 led off downwardly.

It has been shown that with such an arrangement the requirements for continuous operation in connection with chemical processes can be met in which liquids of low density under high pressure like liquefied gases are present in the container at temperatures varying over a wide range in the order of magnitude between −200 and +200 degrees centigrade.

We claim:

1. In a magnetic drive liquid level signal transmitter comprising a body having a side with a magnetic flux permeable wall therein, a float assembly outside said body, a magnet connected to the float to be moved thereby and positioned adjacent the exterior of said wall, a body mounted sleeve at the other side of the wall, said sleeve having an open end, a closed end and an inner wall defining a cavity, a reed switch assembly comprising a reed switch in an inert gas-filled housing, said switch assembly being within said cavity and having a first end adjacent said closed end and a second end closer to said open end than is said first end, said assembly including wires connected to said switch, a cable extending into the open end of the sleeve and having electric lines therein which are soldered to said wires respectively at joints, and a poured sealing mass embedding said switch assembly at said open end, the improvement comprising:

an elastomeric plate extending between and engaging said swtich assembly at said second end thereof and the inner wall of the sleeve, said plate forming a transverse seal across said cavity between said housing and the inner wall, said soldered joints being within the part of the cavity between said plate and said open end, said poured sealing mass filling said part of said cavity and tightly encasing said joints, said mass having a low coefficient of thermal expansion.

2. In a transmitter as set forth in claim 1 and wherein said switch includes electrical terminals at said first end of said switch assembly and external thereof to which terminals said wires are connected, the further improvement comprising:

a silicone rubber embedment about said terminals and the wire connections thereto.

3. A transmitter as set forth in claim 2, including another elastomeric plate extending between and engaging said housing at said first end thereof and the inner wall of the sleeve, said other plate forming a transverse seal across said cavity between said housing and the inner wall.

4. A transmitter as set forth in claim 3, including a plastic sleeve about said terminals and extending from said other plate to said closed end of the first mentioned sleeve, said embedment filling said plastic sleeve.

5. A transmitter as set forth in claim 4, including a spacer plate of insulating material and located in said part of the cavity and between said soldered joints and the first mentioned plate, said spacer plate being smaller in size than the transverse dimension of said cavity and having a plurality of spaced openings therethrough, said wires each extending through a respective opening, said spacer plate being embedded in said mass.

6. A transmitter as set forth in claim 5, wherein said inner wall defining said part of said cavity has a pair of annular grooves therein.

7. A transmitter as set forth in claim 6, wherein said first mentioned and said other plate are made of silicone rubber.

8. A transmitter as set forth in claim 7, wherein said body at said side has a pair of support arms normal to said side and spaced apart in a horizontal direction;

said float assembly including a double armed lever positioned between said arms and connected thereto for pivotal movement about a generally horizontal axis, said lever having ends in each direction from said axis, said magnet being on the end closest to said side, a float on the other end of the lever, and a counterweight on the lever between the magnet end and the axis; and said body having a bore therein with said sleeve being located in said bore.

9. A transmitter as set forth in claim 7, wherein there is another part of the cavity between said elastomeric plates and between the interior of said wall and the exterior of said housing, said other part of the cavity being smaller than five milliliters.

10. A transmitter as set forth in claim 1, including another elastomeric plate extending between and engaging said housing at said first end thereof and the inner wall of the sleeve, said other plate forming a transverse seal across said cavity between said housing and the inner wall, and wherein there is another part of the cavity between said elastomeric plates and between the interior of said wall and the exterior of said housing, said other part of the cavity being smaller than five milliliters.

11. A transmitter as set forth in claim 1, wherein said body at said side has a pair of support arms normal to said side and spaced apart in a horizontal direction;

said float assembly including a double armed lever positioned between said arms and connected thereto for pivotal movement about a generally horizontal axis, said lever having ends in each direction from said axis, said magnet being on the end closest to said side, a float on the other end of the lever, and a counterweight on the lever between the magnet end and the axis; and said body having a bore therein with said sleeve being located in said bore.

12. A transmitter as set forth in claim 11, wherein said bore extends generally vertically upward from the bottom of said body, and said cable enters the body at the bottom of the bore.

* * * * *

UNITED STATES PATENT AND TRADEMARK OFFICE

CERTIFICATE OF CORRECTION

PATENT NO. : 4,258,238

DATED : March 24, 1981

INVENTOR(S) : Ferdinand Dombroski and Dieter Forster

It is certified that error appears in the above-identified patent and that said Letters Patent are hereby corrected as shown below:

On the title page, under "[30] Foreign Application Priority Data", change to read:

"---Sept. 6, 1978 [West Germany] Germany P2838723.7---"

Column 1, line 14, change "inteded" to "---intended---"

Column 3, line 68, change "16" to "---18---"

Column 4, line 2, change "18" to "---16---"

Claim 3, line 3 and Claim 10, line 3, change "housing" to "---switch assembly---"

Signed and Sealed this

*Thirtieth* Day of *June 1981*

[SEAL]

*Attest:*

RENE D. TEGTMEYER

*Attesting Officer*

*Acting Commissioner of Patents and Trademarks*